US010465451B2

(12) United States Patent
Pallini et al.

(10) Patent No.: US 10,465,451 B2
(45) Date of Patent: Nov. 5, 2019

(54) THREAD FORM FOR CONNECTOR COLLAR OF OFFSHORE WELL RISER PIPE

(71) Applicant: Vetco Gray Inc., Houston, TX (US)

(72) Inventors: Joseph W. Pallini, Houston, TX (US); Rockford D. Lyle, Houston, TX (US)

(73) Assignee: VETCO GRAY, LLC, Houston, TX (US)

( * ) Notice: Subject to any disclaimer, the term of this patent is extended or adjusted under 35 U.S.C. 154(b) by 699 days.

(21) Appl. No.: 15/170,499

(22) Filed: Jun. 1, 2016

(65) Prior Publication Data

US 2017/0350199 A1 Dec. 7, 2017

(51) Int. Cl.

| | |
|---|---|
| ***E21B 17/043*** | (2006.01) |
| ***F16L 15/02*** | (2006.01) |
| ***E21B 17/08*** | (2006.01) |
| ***E21B 17/02*** | (2006.01) |
| ***E21B 17/042*** | (2006.01) |
| ***E21B 17/046*** | (2006.01) |

(52) U.S. Cl.

CPC ..... *E21B 17/043* (2013.01); *E21B 17/042* (2013.01); *E21B 17/046* (2013.01); *E21B 17/0426* (2013.01); *E21B 17/085* (2013.01)

(58) Field of Classification Search

None

See application file for complete search history.

(56) References Cited

U.S. PATENT DOCUMENTS

| | | | |
|---|---|---|---|
| 2,318,590 A | 5/1943 | Boynton | |
| 4,265,470 A | 5/1981 | Danner | |
| 5,015,017 A | 5/1991 | Geary | |
| 5,048,871 A | 9/1991 | Pfeiffer et al. | |
| 8,375,995 B2 | 2/2013 | Courtois et al. | |
| 9,145,745 B2 * | 9/2015 | Pallini, Jr. | E21B 17/085 |
| 2013/0140813 A1 | 6/2013 | Pallini, Jr. et al. | |

FOREIGN PATENT DOCUMENTS

EP 0157971 A1 10/1985

OTHER PUBLICATIONS

"Low Cycle Fatigue Analysis of Threaded Connectors for Subsea Drilling and Production", from SPE 166554—Offshore Europe Oil and Gas Conference and Exhibition, Aberdeen, UK Sep. 3-6, 2013—author: Rajesh Kumar, et al.

International Search Report and Written Opinion issued in connection with corresponding PCT Application No. PCT/US2017/34956 dated Sep. 6, 2017.

* cited by examiner

*Primary Examiner* — Matthew R Buck
*Assistant Examiner* — Douglas S Wood
(74) *Attorney, Agent, or Firm* — Hogan Lovells US LLP

(57) ABSTRACT

A pipe connection includes a pin having circumferentially extending external grooves. A box has an annular base with deflectable fingers extending upward from the base. Each of the fingers has circumferentially extending internal grooves on an inner side and an external thread on an outer side. A collar has an internal thread on an inner side. A radial dimension from the axis to the internal thread crest decreases from turn to turn of the internal thread in a downward direction. The box and the pin are movable from a stab-in position to a locked position in response to rotation of the collar. In the locked position, the external thread crests are in engagement with the internal thread crests, and the internal grooves are in full engagement with the external grooves.

19 Claims, 7 Drawing Sheets

THREAD FORM FOR CONNECTOR COLLAR OF OFFSHORE WELL RISER PIPE

FIELD OF THE DISCLOSURE

This disclosure relates in general to a threaded box and pin connection between offshore well riser pipes, the connection having a rotatable collar that forces cantilevered fingers of the box into engagement with grooves on the pin when the collar is rotated relative to the box and pin.

BACKGROUND

Risers are used in offshore drilling and production to connect a surface platform to subsea equipment of a well. Drilling risers are used during drilling operations. Production risers are normally used to convey production fluids from the subsea well to the platform. One type of a production riser comprises pipes having threaded ends that connect together.

The length of a production riser may be thousands of feet, and the diameter can be fairly large. As the riser string is being made up and run into the sea, a new pipe or joint being added to the upper end of the riser string will be rotated to make up the threads. Rotating the new joint while avoiding cross-threading can be difficult.

In U.S. Pat. No. 9,145,745, the new joint is added without requiring rotation. A collar with internal threads is rotated relative to both the box and the pin. The box has deflectable fingers with internal grooves that mesh with external grooves on the pin as the collar rotates. A collet ring is located between the fingers and the collar, and has external threads that engage the internal threads of the collar. By requiring a collet ring, the connector of U.S. Pat. No. 9,145,745 has more elements over other types of connectors.

SUMMARY

A pipe connection comprises a pin having circumferentially extending external grooves. A box has an annular base and cantilevered fingers joining the base and extending from the base in a first direction. The cantilevered fingers are spaced around the axis and have free ends. Each of the fingers has circumferentially extending internal grooves and an external thread. A collar has an internal thread that engages the external thread. The box and the pin have a stab-in position in which the internal grooves are spaced radially outward from full engagement with the external grooves. Rotating the collar relative to the pin and the box in a locking direction from the stab-in position to a locked position deflects the internal grooves of the fingers inward into full mating engagement with the external grooves.

In the embodiment show, each of the crests of the internal thread faces toward the axis and in the second direction. A stop shoulder engages the collar while the collar is in the stab-in position and also in the locked position. The stop shoulder prevents any axial movement of the collar relative to the box and the pin while rotating the collar from the stab-in position to the locked position.

While the pin and the box are in the stab-in position, the crests of the external thread are located in roots of the internal thread and the crests of the internal thread are located in roots of the external thread. While the pin and the box are in the locked position, the crests of the internal thread are abutting the crests of the external thread.

In the embodiment shown, the internal thread has a first flank and a second flank separated by one of the crests of the internal thread, the second flank being closer to the base than the first flank and having a lesser depth than the first flank.

In one embodiment, each of the crests of the internal threads increase in diameter from turn to turn in a second direction from the free ends toward the base.

A release ring may be mounted to an inner side of the collar, the release ring having a conical portion that engages an inner side of each of the fingers adjacent the free ends. The box and the pin have a released position that is achieved in response to rotation of the collar relative to the pin and the box in a releasing direction from the locked position. The rotation of the collar in the releasing direction causes the collar and the release ring to move axially in the second direction and deflects the fingers and the internal grooves outward from full mating engagement with the external grooves.

In one embodiment, a tangent line at a midpoint of each of the internal thread crests intersects the axis at an acute angle, the acute angle decreasing from turn to turn in the second direction.

External sides of the cantilevered fingers circumscribe a cylindrical surface in the embodiment shown. The external thread is formed in a plurality of turns on the cylindrical surface. A radial distance from each turn of the external thread to the axis is the same for all of the turns.

The external grooves are located on a conical surface of the pin. The internal grooves are located on a conical surface of the box. The external thread is located on a cylindrical surface of each of the fingers. The internal thread is located on a cylindrical surface of the collar.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

Figure 1:
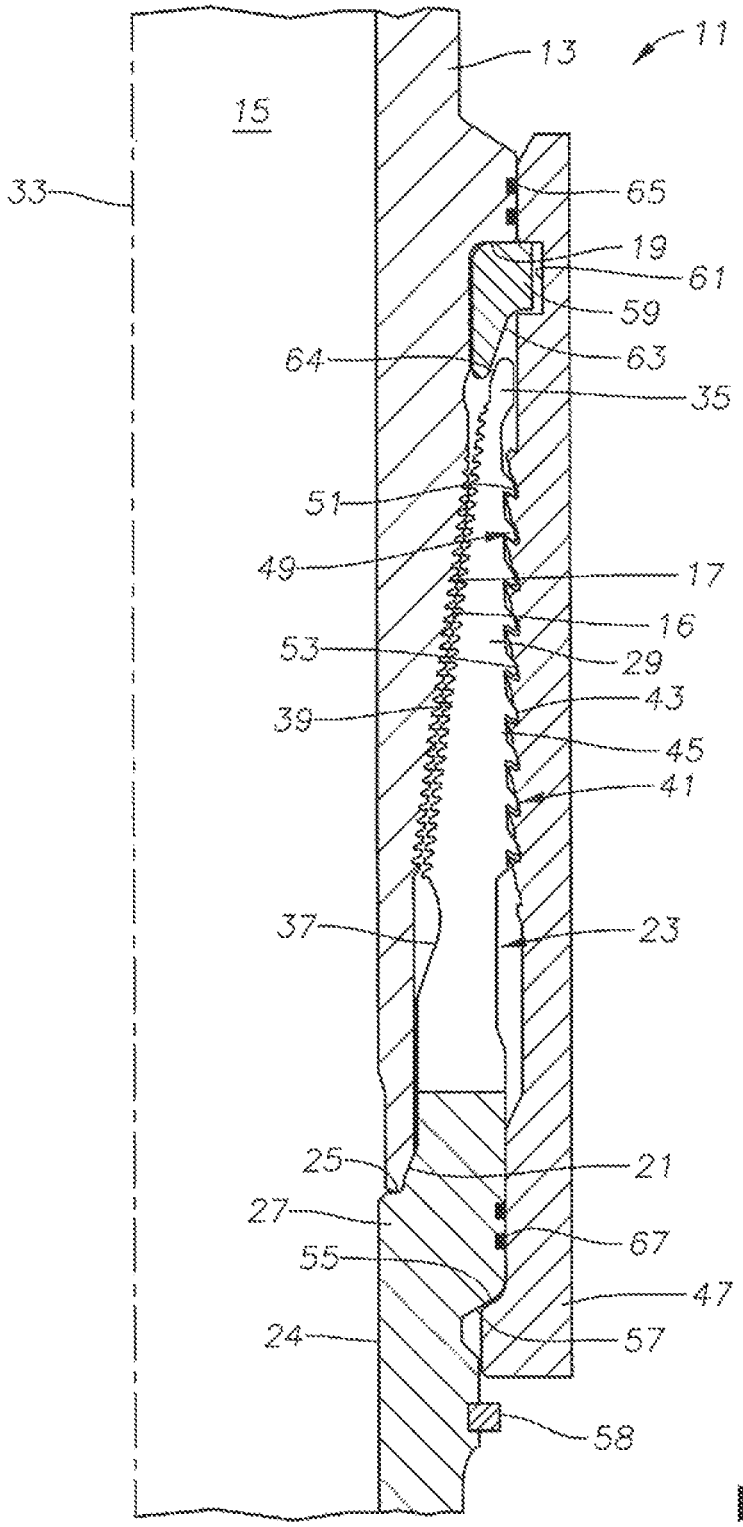
FIG. 1 is a quarter sectional view of a portion of a box and pin connection between riser pipes, showing the pin stabbed into the box in a stab-in position with the collar not yet rotated to make up the connection.

Referring to FIG. 1, connector 11 is a metal assembly, normally steel, that connects two pipes together. The pipes may particularly be drilling riser pipes extending from a surface platform to subsea well equipment. Connector 11 includes a pin 13, which is illustrated as facing downward, but it could be oriented upward. Pin 13 is typically welded to a pipe (not shown) and has a bore 15 for conveying fluid to and from the pipe. Pin 13 has an exterior conical portion 16 that reduces in diameter in a downward direction. Pin 13 has external grooves 17 extending circumferentially around the conical exterior portion 16. In this example, pin grooves 17 are not a continuous helical thread; rather pin grooves 17 are parallel to and separate from each other. Pin 13 has an external downward facing shoulder 19 near its upper end. Pin 13 has a nose 21 on its lower end.

Connector 11 includes a box 23 in which pin 13 stabs and connects. Box 23 is typically welded to another pipe (not shown). Box 23 is has a bore 24 to receive pin 13, bore 24 having an internal upward facing shoulder 25. In this example, pin nose 21 forms a metal-to-metal seal with bore 24 near shoulder 25. Alternately, a separate seal could be employed between pin nose 21 and shoulder 25.

Figure 7:
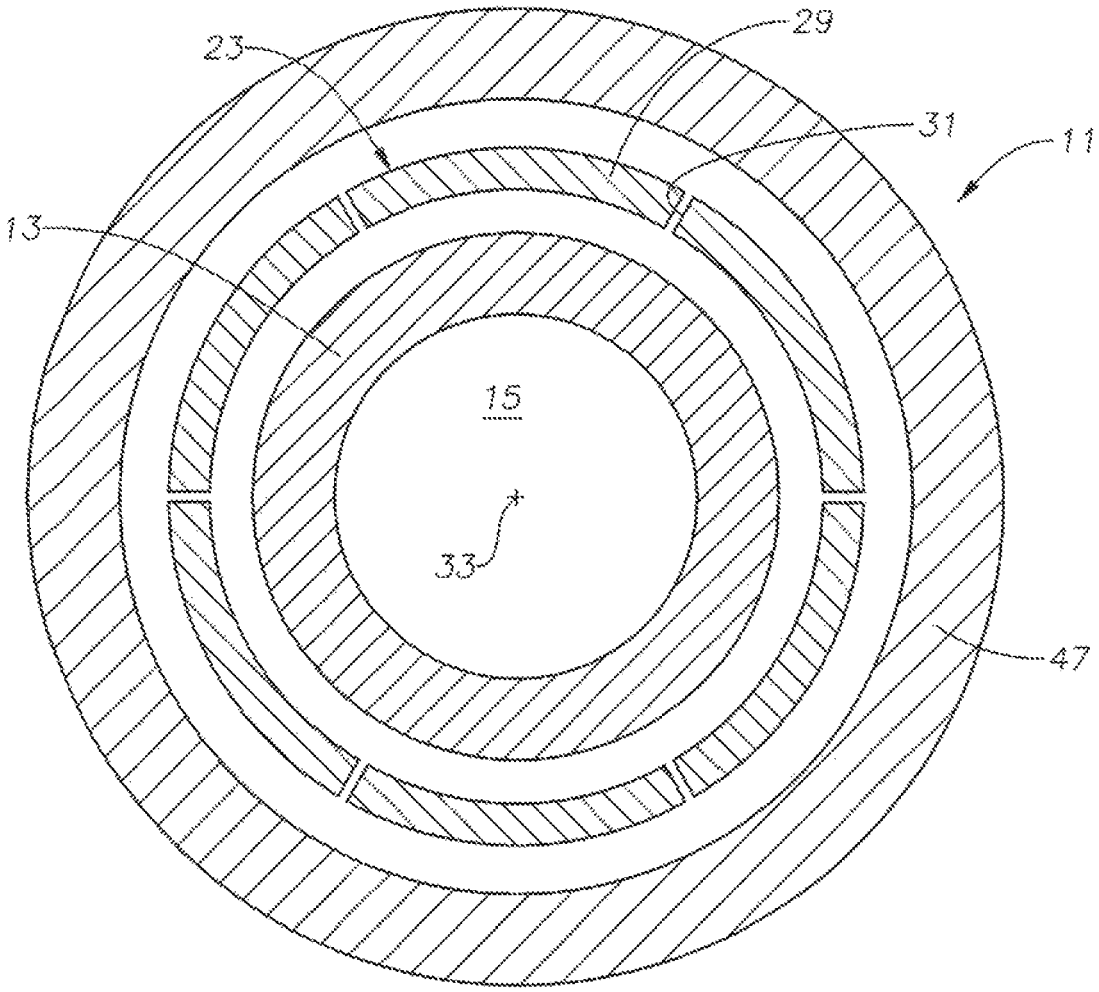
FIG. 7 is schematic transverse sectional view of box and pin connector of FIG. 2.

Box 23 has an annular base 27 on its lower end that is a solid, non-expansible ring. A plurality of cantilevered segments or fingers 29 are integrally formed with base 27 and extend upward. As shown the not-to-scale schematic of FIG. 7, slits 31 separate each finger 29, the outer side of which is a portion of a cylinder. Slits 31 are parallel with a longitudinal axis 33 of box 23. The number of fingers 29 may vary from the schematic illustration of FIG. 7. The circumferential width of each finger 29 is constant from base 27 to an upper free end 35. FIG. 7 is not to scale. Actually, the diameters of the components shown would be much larger.

Figure 2:
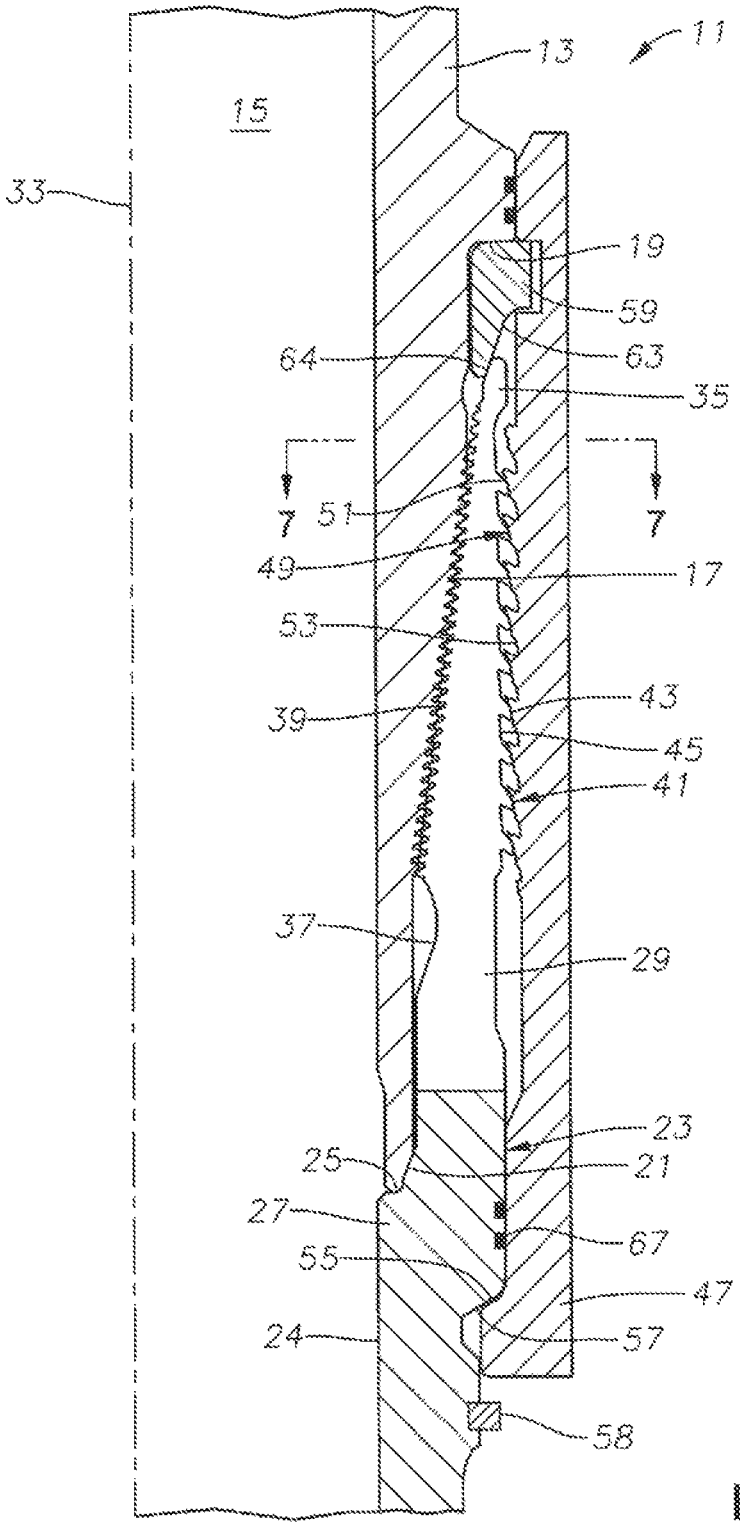
FIG. 2 is quarter sectional view of the box and pin connection of FIG. 1 showing the collar rotated to a locked position locking the box and pin together.

Fingers 29 are configured to bend about their lower portions and deflect radially inward in a curved path from the unlocked, stab-in position shown in FIG. 1 to the locked position shown in FIG. 2. The flexing from the stab-in to the locked position is elastic, not permanent and does not exceed the yield strength of the material of box 23. A reduced radial thickness portion 37 in each finger 29 near base 27 facilitates the deflection of fingers 29.

A set of internal grooves 39 is formed on a conical portion 38 of bore 24 above reduced thickness portion 37. The taper angle relative to axis 33 of box conical portion 38 is approximately the same as the taper angle of pin conical portion 16 while box conical portion 38 is in the stab-in position of FIG. 1 and the locked position of FIG. 2. Internal grooves 39 have the same configuration as external grooves 17, being perpendicular to axis 33, extending circumferentially around fingers 29 and axially separated from each other. Internal grooves 39 are configured to fully engage or mate with external grooves 17 when moved to the locked position of FIG. 2. In the stab-in position, internal grooves 39 are spaced radially from full engagement with external grooves 17 so as to allow pin 13 to be stabbed in.

In this embodiment, a radial gap between internal grooves 39 and external grooves 17 while in the stab-in position is substantially constant from the lower end to the upper end of the conical portions 16, 38. At the upper end of pin conical portion 16, in this example, external grooves 17 diminish in depth where the pin conical portion 16 transitions to a cylindrical surface. Similarly, at the upper end of the box conical portion 38, the taper angle may change, resulting in a diminished depth of internal grooves 39.

Box 23 has an external thread 41 machined on its outer diameter, which is cylindrical in the embodiment. External thread 41 may be a single, continuous helical thread form extending along the outer sides of fingers 29. Each turn of external thread 41 has a crest 43 with roots 45 above and below, the configuration of which will be discussed in more detail subsequently.

A collar or sleeve 47 fits around box 23 and may be rotated a selected amount relative to box 23 and pin 13. Collar 47 has an internal thread 49 that engages external thread 41. Internal thread 49 is a single, continuous thread machined on the cylindrical inner diameter surface of collar 47. Each turn of internal thread 49 has a crest 51 with roots 53 above and below.

Figure 3:
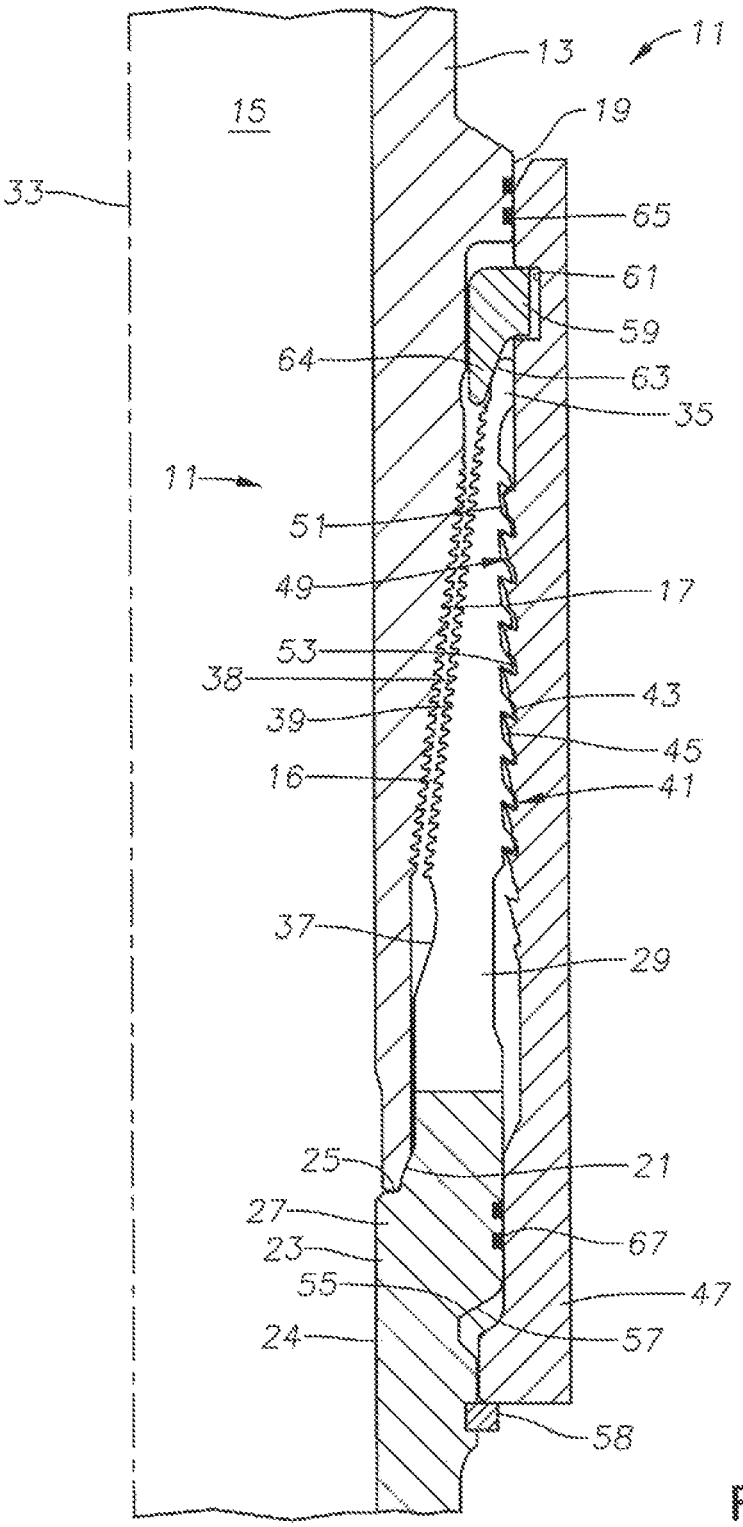
FIG. 3 is an enlarged section view of the box and pin connection of FIG. 2, with the collar rotated in reverse from the locked position to a released position to release the pin from the box.

Collar 47 has an upward facing internal shoulder 55 near its lower end. Box 23 has an external shoulder 57 that is abutted by internal shoulder 55 while connector 11 is in the stab-in position of FIG. 1 and in the locked position of FIG. 2. During rotation in the locking direction, shoulders 55, 57 prevent any upward movement of collar 47 relative to box 23. Collar 47 can be rotated in the reverse, releasing direction relative to box 23. Rotation in the releasing direction causes downward movement of collar 47 relative to box 23 to disconnect or release connector as shown in FIG. 3. While in the released position of FIG. 3, an axial gap will exist between shoulders 55, 57. The downward movement of collar 47 may be limited by contact with a retainer ring 58 secured in a groove on the outer diameter of box 23.

A release ring 59 is secured in an internal recess 61 in collar 47. Release ring 59 is a solid, annular member with a tapered or conical lower portion 63 that faces downward and outward. While in the stab-in position of FIG. 1, conical lower portion 63 is illustrated as being spaced from upper inner surfaces 64 of free ends 35 of fingers 29. While in the locked position of FIG. 2, conical surface 63 could contact the upper inner surfaces 64 of fingers 29, as shown, but the contact should be very light, with no outward force being exerted on the upper inner surfaces 64 of free ends 35. Alternately, a clearance between conical surface 63 and the upper inner surfaces 64 of free ends 35 could exist while in the locked position. While moving to the released position of FIG. 3, conical surface 63 contacts upper inner surfaces 64 and exerts a wedging outward force on fingers 29.

Upper seals 65 seal between the inner diameter of collar 47 and pin external shoulder 19 near the upper end of collar 47. Lower seals 67 seal between the inner diameter of collar 47 to the exterior of box 23 near the lower end of collar 47.

Briefly, to make up connector 11, collar 47 will be positioned in the stab-in position. Crests 43 of external thread 49 are located in roots 53 of internal thread 49. A radial gap will exist between full engagement of pin external grooves 17 with box internal grooves 39. The operator inserts pin 13 into box 23 until the lower side of shoulder 19 abuts release ring 59. Pin nose 21 will sealingly engage bore 24.

Then the operator rotates collar 47 in a locking direction, normally clockwise, relative to pin 13 and box 23. This rotation cannot move collar 47 upward relative to pin 13 and box 23 because of the engagement of shoulders 55, 57. As a result, the rotation causes internal thread crests 51 to gradually move in a curved path into engagement with external thread crests 43 to flex fingers 29 inward. Fingers 29 flex like cantilevered beams. This deflection of fingers 29 causes internal grooves 39 to fully engage with external grooves 17, as shown in FIG. 2. The amount of travel of finger internal grooves 39 between the stab-in position and the locked position increases from groove 39 to groove 39 from the lower end of grooves 39 upward. The difference in arcuate travel of each internal groove 39 occurs because the flexing movement of fingers 29. Once in the locked position, a wedge-type device (not shown) may be installed between collar 47 and box 23 to keep collar 47 in the locked position, if desired. The amount of rotation of collar 47 from the stab-in to the locked position may be less than one full turn, such as about one-half of a turn.

To disconnect connector 11, the operator rotates collar 47 in the reverse direction from the locked position shown in FIG. 1. The counterclockwise rotation moves collar 47 downward into contact with retainer ring 58. Internal thread crests 51 will align with and enter external thread roots 45, allowing fingers 29 to flex back in an outward direction. As release ring 59 moves downward, it will exert an outward force on the finger upper end portion 64 to cause the outward radial movement. Once in the released position of FIG. 3, the operator is then free to withdraw pin 13 from box 23.

Figure 4:
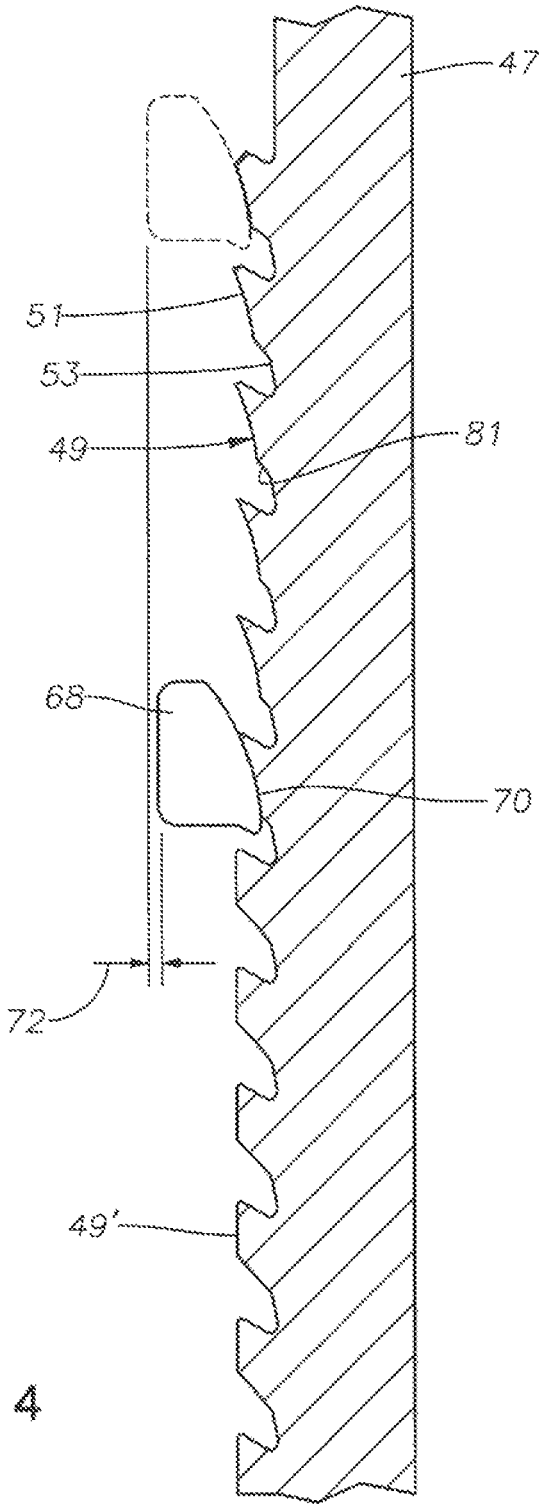
FIG. 4 is a schematic view illustrating how the internal threads on the collar may be formed.

FIG. 4 schematically illustrates one example of how the collar internal threads 49 are machined. First, a straight uniform initial thread cut, indicated by the numeral 49' is made. Then, a cutting insert 68 with a specially curved outer side 70 will be moved down initial internal thread 49' as collar 47 rotates. Curved outer side 70 may have a single radius with a center point (not shown) inward and downward from cutting insert 68. As indicated by the dotted lines, as cutting insert 68 moves down over initial cut 49', curved outer side 70 will cut crests 51 into the desired shaped. Each crest 51 is tapered, either curved, as shown, or with a straight conical surface. In this example, each crest 51 is generally concave or dish-shaped, having a recessed surface that faces in a direction between downward and inward toward axis 33. The curvature of crest 51 will be related to the arcuate travel that fingers 29 (FIG. 1) make while moving from the stab-in position to the locked position.

Also, in this example, cutting insert 68 is moved radially outward from axis 33 (FIG. 1) slightly to make a gradually deeper cut of crest 51 as cutting insert 68 moves downward. The dimension 72 represents the radial outward movement of cutting insert 68 as it moves downward along initial cut 49'. As a result, each crest 51 is a little farther from axis 33 than the crest 51 immediately above and a little closer to axis 33 than the one immediately below. Internal thread roots 53 are not cut on the second pass with die 68, only the crests 51. As a result, roots 53 are all at the same distance from axis 33.

In addition to the radial outward movement of cutting insert 68 in this example, cutting insert 68 is controlled to move downward along initial thread cut 49' at a slightly less pitch than the pitch of initial thread cut 49'. That is, the axial distance from cutting insert 68 while in the dotted line position to the solid line position is slightly less than the axial distance between internal threads 49 adjacent the dotted line position of cutting insert 68 and the solid line position of cutting insert 68. As a result, a gradually steeper portion, relative to axis 33 (FIG. 2), of cutting insert curved outer side 70 forms the cutting action as cutting insert 68 moves downward. The curvature of crest 51 adjacent the dotted line position of cutting insert 68 differs slightly relative to axis 33 than the curvature adjacent the solid position of cutting insert 68. Stated another way, a line tangent to a midpoint of crest 51 intersects axis 33 at an acute angle. That angle slightly decreases from crest 51 to crest 51 in a downward direction due to the curvature of crests 51 and the difference in pitch.

The example of FIG. 4 is a combination of both an increase in diameter from crest 51 to crest 51 in a downward direction plus the pitch difference described. It is feasible to form thread 49 with only the increase in diameter in a downward direction whether or not crests 51 are curved or simply straight conical surfaces. It is also possible to form thread 49 with only the pitch difference of cutting insert 68 as it cuts curved crests 51 and with no increase in diameter in a downward direction. If only the pitch difference is employed and not the increase in diameter, each crest 51 would have a point that is the sane distance from axis 33 as all the other crests 51. However, that point would be at a different distance from the upper end of each crest 51 than the other crests 51. That point gets closer to the upper end of crest 51 from turn to turn in a downward direction if only the pitch difference is employed.

Base fingers 29 may be machined so that the stab-in position (FIG. 1) is a neutral position between fully engaged (FIG. 2) and released (FIG. 3). In the neutral position, fingers 29 will not be under either inward or outward stress. That is, fingers 29 will not be flexed either inward or outward. While flexed inward into the fully engaged position, fingers 29 will be under a radial inward pre-load force due to the engagement of internal thread crests 51 pushing outward on external thread crests 43. While flexed outward by release ring 59 into the released position, fingers 29 will be under an outward directed force.

Figure 5:
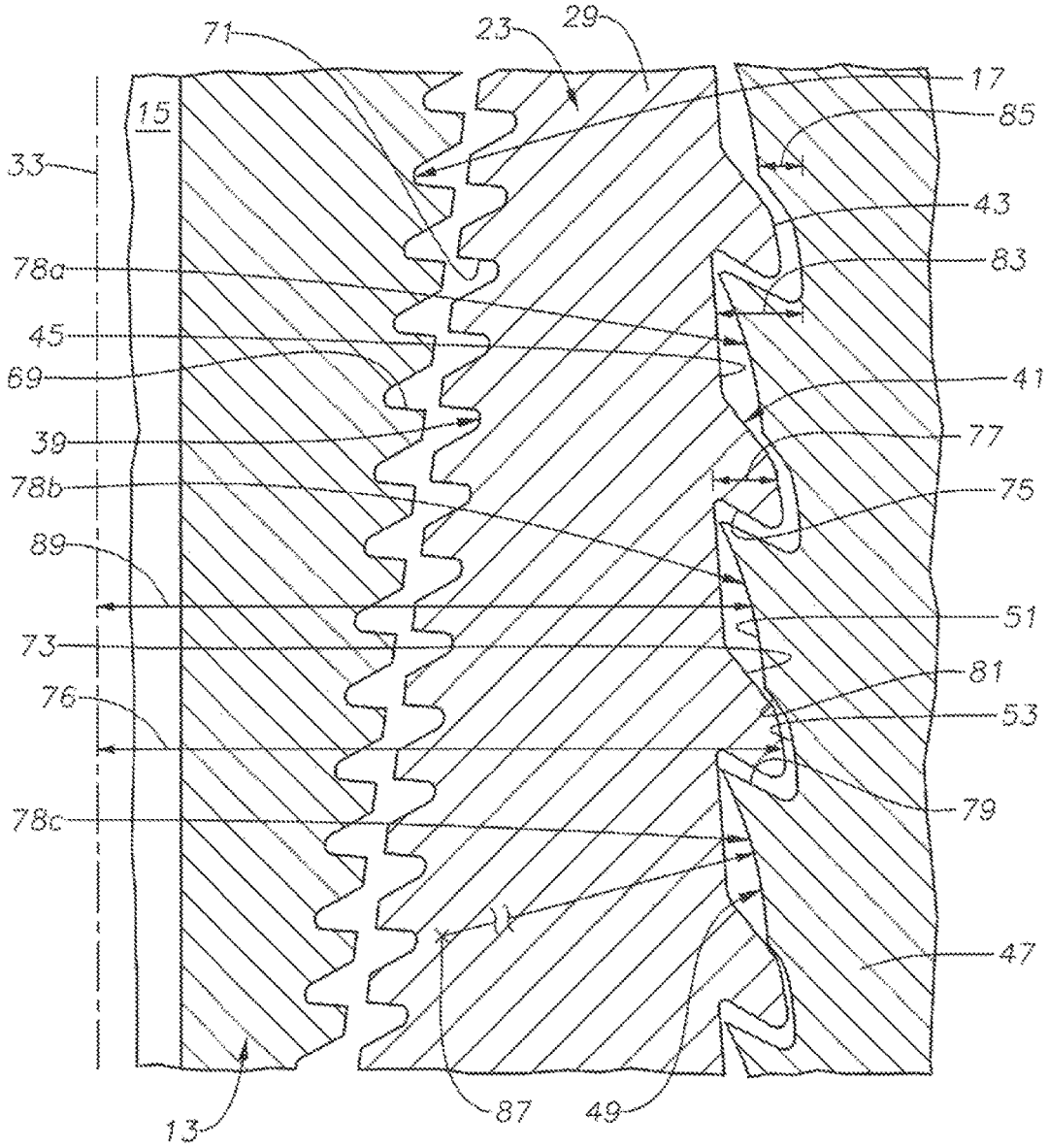
FIG. 5 is an enlarged quarter sectional view of part of the box and pin connection of FIG. 1 in the unlocked position.

FIG. 5 is an enlarged view of a portion of FIG. 1, showing connector 11 in a stab-in position. Pin external grooves 17 have the same configuration as box finger internal grooves 39. The configuration may vary, and in this example, each pin external groove 17 has an upward facing load flank 69 that inclines downward relative to axis 33 by an amount that could be as much as 12 degrees. Each box finger internal groove 39 has a downward facing load flank 71 that will mate with upward facing load flank 69. In the stab-in position of this embodiment, box finger load flanks 71 are radially outward a short distance from pin load flanks 69 and not touching.

Box finger external thread 41 has an upward facing flank 73 at each turn. Upward facing flank 73 inclines downward and outward relative to axis 33. Box finger external thread 41 has at each turn a downward facing flank 75 separated from upward facing flank 73 by root 45. In this example, downward facing flank 75 inclines downward at a lesser angle relative to axis 33 than upward facing flank 73. Crest 43 joins the outer ends of flanks 73, 75 to each other. Crest 43 may be slightly convex or rounded in an outward direction relative to axis 33. The corners between flanks 73, 75 and crest 43 are rounded. The corner between downward facing flank 75 and crest 43 is slightly farther from axis 33 than the corner between upward facing flank 73 and the same crest 43. A tangent line (not shown) of a midpoint of crest 43 intersects axis 33 at an acute angle. Roots 45 are also slightly tapered, rather than being cylindrical. A radial distance 76 from a midpoint of each root 45 to axis 33 may be the same for all of the roots 45. The radial depths 77 of all of the crests 43 from a root 45 to a crest midpoint are the same.

FIG. 5 shows three full turns 78*a*, 78*b* and 78*c* of collar internal thread 49. Each thread turn has an upward facing flank 79 and a downward facing flank 81 separated by one of the roots 53. The axial dimension of each crest from flank 79 to flank 81 is constant and greater than an axial dimension of each external thread crest 43. Upward facing flank 79 of each turn faces upward and outward relative to axis 33. Downward facing flank 81 faces downward and inward. In this example, downward facing flank 81 is at a steeper taper than upward facing flank 79. For each turn 78*a*, 78*b* and 78*c*, the radial depth 83 of upward facing flank 70 from root 53 is much greater than the radial depth 85 of downward facing flank 81. Also, the radial depth 83 of each upward facing flank 79 is greater than the radial depth 83 of the upward facing flank 79 of the next lower turn. Similarly, the radial depth 83 of upward facing flank 79 of turn 78*b* is greater than the radial depth 83 of upward facing flank 79 of turn 78*c*. In the same manner, the radial depth 85 of each downward facing flank 81 is less for the next lower downward facing flank 81.

A center point 87 for the radius of each curved crest 51 is in a direction between downward and inward toward axis 33. As mentioned above, each curved crest 51 gradually becomes less steep relative to axis 33 in a downward direction. Thus, the axial distance that each center point 87 is below its crest 51 become less in a downward direction, from crest 51 to crest 51. A radial distance 89 from a midpoint of each crest 51 to axis 33 increases from turn-to-turn in a downward direction. That is, radial distance 89 for crest 51 of turn 78*a* is less than radial distance 89 for crest 51 of turn 78*b*. Similarly, radial distance 89 for crest 51 of turn 78*b* is less than radial distance 89 for crest 51 of turn 87*c*. In this example, the pitch of internal threads 49 from one turn to another is constant and is the same as the pitch of external threads 41. The pitch of internal thread crests 51 is slightly less than the pitch of eternal thread crests 43.

Figure 6:
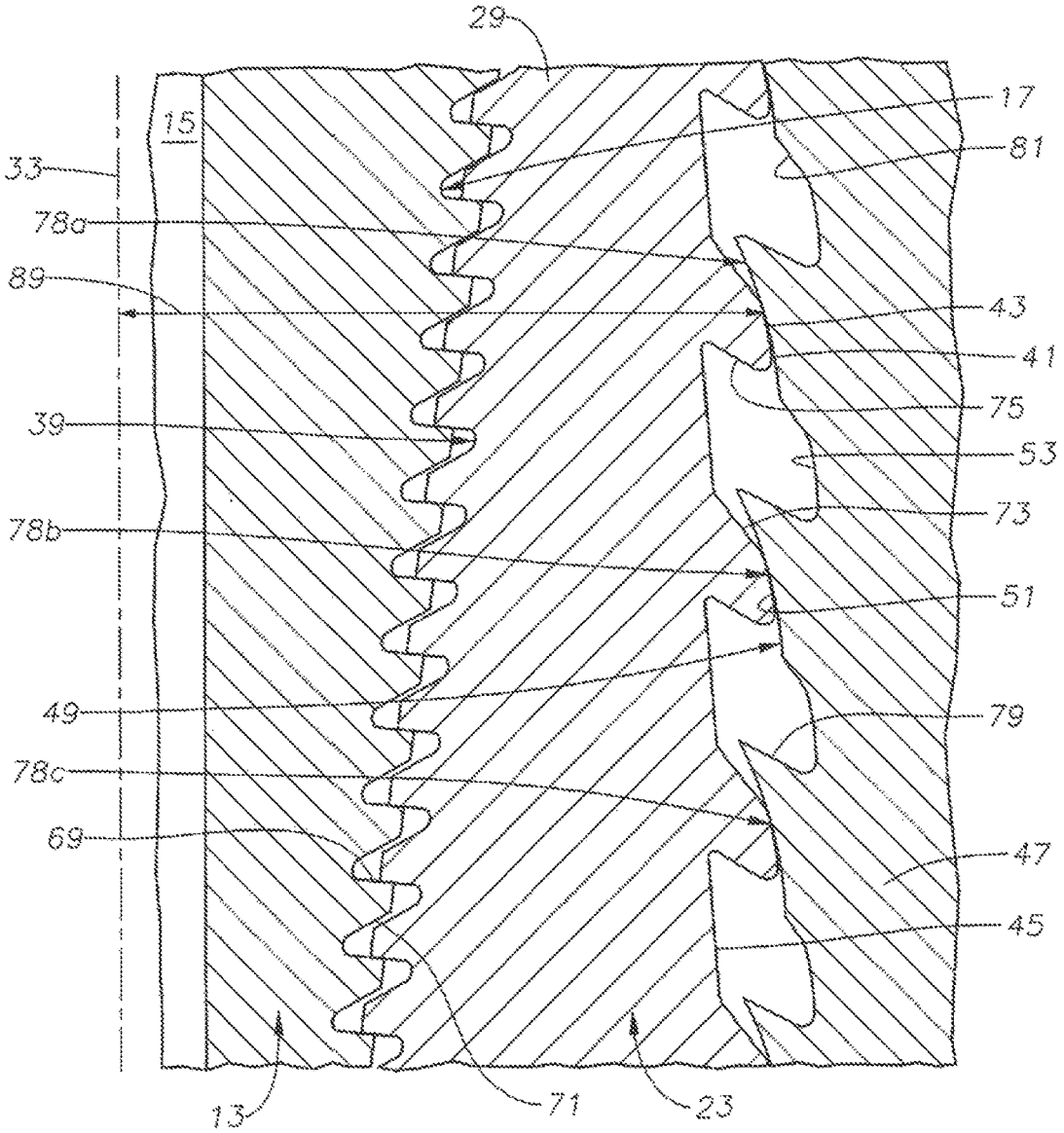
FIG. 6 is an enlarged quarter sectional view of part of the box and pin connection of FIG. 2 in the locked position.

In the stab-in position of FIG. 5, collar 47 is rotated to a position with release ring 59 abutting downward facing shoulder 19 (FIG. 1). External thread crests 43 will be located in internal thread roots 53, and flanks 75, 79. Pin 13 is lowered into box 23, then technicians will rotate collar 47. As collar 47 rotates, stab flanks 73, 75 engage, then internal thread crests 51 will begin engaging external thread crests 43 because of the helical path of internal thread crests 51 during locking direction rotation. The engagement during locking direction rotation causes fingers 29 to deflect along a curved inward path, as shown in FIG. 6. The increase in flank depth 83 in an upward direction along internal threads 49 causes the upper part of fingers 29 to travel a greater distance than a lower part. As a result, in the locked position of FIG. 6, the contact surface between internal groove flank 71 and external groove flank 69 decreases in a downward direction. The extent of overlap of internal groove flank 71 with external groove flank 69 while in the fully engaged or locked position is greater than the overlap of the grooves 69, 71 immediately below.

In the embodiment shown, pin grooves 17 do not interfere with box grooves 39 during stab-in. Alternately, connector 11 could be machined such that pin grooves 17 lightly engage box grooves 39 as pin 13 is stabbed into box 23. In that embodiment, a pin 13 lowers into box 23, a ratcheting action would occur, with fingers 29 flexing inward and outward.

It is to be understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. For example, the connector could be inverted are placed in other orientations from the orientation shown. The thread form of the internal thread could be placed on the outer sides of the fingers and the thread form of the external thread could be placed on the inner side of the collar.

The invention claimed is:

1. A pipe connection, comprising:

a pin having circumferentially extending external grooves;

a box having an annular base with an axis, cantilevered fingers joining the base and extending from the base in a first direction, the cantilevered fingers spaced around the axis and having free ends, each of the fingers having circumferentially extending internal grooves and an external thread having crests;

a collar having a plurality of turns of an internal thread on an inner side, each of the turns of the internal thread having an internal thread crest, wherein an axial dimension of each of the internal thread crests is greater than an axial dimension of each of the external threads crests; wherein the box and the pin have a stab-in position in which the internal grooves are spaced radially outward from full engagement with the external grooves; and rotating the collar relative to the pin and the box in a locking direction from the stab-in position to a locked position deflects the internal grooves of the fingers inward into full mating engagement with the external grooves.

2. The connection according to claim 1, wherein each of the crests of the internal thread faces toward the axis and in a second direction.

3. The connection according to claim 1, further comprising:

a stop shoulder that engages the collar while the collar is in the stab-in position and also in the locked position; and wherein the stop shoulder prevents any axial movement of the collar relative to the box and the pin while rotating the collar from the stab-in position to the locked position.

4. The connection according to claim 1, wherein:

while the pin and the box are in the stab-in position, the crests of the external thread are located in roots of the internal thread and the crests of the internal thread are located in roots of the external thread; and while the pin and the box are in the locked position, the crests of the internal thread are abutting the crests of the external thread.

5. The connection according to claim 1, wherein the internal thread comprises:

a first flank and a second flank separated by one of the crests of the internal thread, the second flank being closer to the base than the first flank and having a lesser depth than the first flank.

6. The connection according to claim 1, wherein each of the crests of the internal threads increase in diameter from turn to turn in a second direction from the free ends toward the base.

7. The connection according to claim 1, further comprising:

a release ring mounted to an inner side of the collar, the release ring having a conical portion that engages an inner side of each of the fingers adjacent the free ends; and the box and the pin having a released position that is achieved in response to rotation of the collar relative to the pin and the box in a releasing direction from the locked position, the rotation of the collar in the releasing direction causing the collar and the release ring to move axially in the second direction and deflecting the fingers and the internal grooves outward from full mating engagement with the external grooves.

8. The connection according to claim 1, wherein:

a tangent line at a midpoint of each of the internal thread crests intersects the axis at an acute angle, the acute angle decreasing from turn to turn in the second direction.

9. The connection according to claim 1, wherein:

the external grooves are located on a conical surface of the pin;

the internal grooves are located on a conical surface of the box;

the external thread is located on a cylindrical surface circumscribed by the fingers; and the internal thread is located on a cylindrical surface of the collar.

10. A pipe connection, comprising:

a pin having circumferentially extending external grooves;

a box having an annular base with an axis, deflectable fingers joining the base and extending in a first direction from the base, the fingers being spaced from each other by slits and having free first ends;

each of the fingers having circumferentially extending internal grooves on an inner side and a plurality of turns of an external thread on an outer side, each of the turns of the external thread having an external thread crest separated by an external thread root;

a cylindrical collar having a plurality of turns of an internal thread on an inner side, each of the turns of the internal thread having an internal thread root and an internal thread crest, the internal thread crests being curved in a concave shape such that a tangent line at a midpoint of the an internal thread crests intersects the axis at an acute angle, the acute angle decreasing from turn to turn in the second direction; wherein the box and the pin have a stab-in position in which the internal grooves are spaced radially out of full engagement with the internal grooves, and the external thread crests are located in the internal thread roots;

the box and the pin are movable from the stab-in position to the locked position in response to rotation of the collar relative to the pin and the box in a locking direction; and in the locked position, the external thread crests are in engagement with the internal thread crests, and the internal grooves are in full engagement with the external grooves.

11. The connection according to claim 10, wherein:

the collar is prevented from axial movement while being rotated in the locking direction from the stab-in position to the locked position.

12. The connection according to claim 10, wherein:

an axial dimension of each of the internal thread crests is greater than an axial dimension of each of the external threads crests.

13. The connection according to claim 10, wherein:

each of the internal thread crests is defined by an internal thread first flank and an internal thread second flank, with the internal thread root extending between the internal thread first flank and the internal thread second flank; and the internal thread first flank has a greater depth than the internal thread second flank.

14. The connection according to claim 10, wherein:

a selected point on each of the internal thread crests is at the same distance from the axis, and the selected point becomes closer to a first tip of the crest of each of the turns from turn to turn in a second direction.

15. The connection according to claim 10, further comprising:

a release ring mounted to the inner side of the collar, the release ring having a conical portion that engages the inner side of each of the fingers adjacent the free ends; and the box and the pin have a released position that is achieved by rotating the collar relative to the pin and the box in a releasing direction from the locked position, the rotation of the collar in the releasing direction causing the collar and the release ring to move in a second direction and deflecting the fingers and the internal grooves outward from full mating engagement with the external grooves.

16. A pipe connection, comprising:

a pin having circumferentially extending external grooves;

a box having an annular base with an axis and fingers joining and extending axially from the base, the fingers being spaced from each other by slits and having free ends;

each of the fingers having circumferentially extending internal grooves on an inner side and a plurality of turns of an external thread on an outer side, the external thread having a crest;

a cylindrical collar having a plurality of turns of an internal thread on an inner side;

each of the turns of the internal thread having a first flank separated from a second flank by a root and an internal thread crest, a tapered crest extending between tips of the first flank and the second flank, a radial distance from the axis to the tip of the first flank being less than a radial distance from the axis to the tip of the second flank of each of the turns, the radial distances from the axis to the tips of the first and second flanks increasing from one turn to the next turn in the second direction, wherein an axial dimension of the internal thread crests is greater than an axial dimension of the external threads crests; wherein the box and the pin have a stab-in position in which the internal grooves are spaced radially out of full engagement with the internal grooves and the crests of the external thread are located between first flank and the second flank of the internal thread;

the box and the pin are movable from the stab-in position to the locked position in response to locking direction rotation of the collar relative to the pin and the box;

a stop on the box that prevents axial movement of the collar during the locking direction rotation from the stab-in position; and in the locked position, the crests of the external threads are in abutment with the crests of the internal threads, the free ends of the fingers have deflected inward, and the internal grooves are in full engagement with the external grooves.

17. The connection according to claim 16, wherein:

the roots of each of the turns of the internal thread are located a same distance from the axis.

18. The connection according to claim 16, wherein:

the first flank of each of the turns of the internal thread has a greater dimension from the root to the tip of the first flank than the second flank.

19. The connection according to claim 16, wherein:

the internal thread is formed on a cylindrical surface of the collar; and the external thread is formed on a cylindrical surface circumscribed by the fingers.

* * * * *